US011302508B2

(12) United States Patent
Krokhmal et al.

(10) Patent No.: US 11,302,508 B2
(45) Date of Patent: Apr. 12, 2022

(54) X-RAY TUBE

(71) Applicant: BRUKER TECHNOLOGIES LTD., Migdal Haemek (IL)

(72) Inventors: Alexander Krokhmal, Haifa (IL); John Wall, Newton Aycliffe (GB)

(73) Assignee: BRUKER TECHNOLOGIES LTD., Migdal HaEmek (IL)

( * ) Notice: Subject to any disclaimer, the term of this patent is extended or adjusted under 35 U.S.C. 154(b) by 49 days.

(21) Appl. No.: 16/676,553

(22) Filed: Nov. 7, 2019

(65) Prior Publication Data

US 2020/0168427 A1 May 28, 2020

Related U.S. Application Data

(60) Provisional application No. 62/757,297, filed on Nov. 8, 2018.

(51) Int. Cl.

| | |
|---|---|
| ***H01J 35/08*** | (2006.01) |
| ***H01J 35/14*** | (2006.01) |
| ***H01J 35/06*** | (2006.01) |

(52) U.S. Cl.

CPC ..... *H01J 35/112* (2019.05); *H01J 35/14* (2013.01); *H01J 35/064* (2019.05); *H01J 35/116* (2019.05); *H01J 2235/086* (2013.01); *H01J 2235/1291* (2013.01)

(58) Field of Classification Search

CPC ..... H01J 2235/086; H01J 2235/1291; H01J 35/064; H01J 35/112; H01J 35/116; H01J 35/14; H01J 35/153

See application file for complete search history.

(56) References Cited

U.S. PATENT DOCUMENTS

| | | | | |
|---|---|---|---|---|
| 3,230,409 | A * | 1/1966 | Farrell | G21K 1/093 378/126 |
| 3,239,706 | A | 3/1966 | Farrell et al. | |
| 3,609,432 | A | 9/1971 | Shimula | |
| 3,668,454 | A | 6/1972 | Shimura | |
| 3,732,426 | A | 5/1973 | Shimizu | |
| 4,119,855 | A | 10/1978 | Bernacki | |
| 4,336,476 | A * | 6/1982 | Holland | H01J 35/10 378/125 |
| 4,573,186 | A | 2/1986 | Reinhold | |
| 4,631,742 | A | 12/1986 | Oliver | |
| 4,675,890 | A | 6/1987 | Plessis et al. | |

(Continued)

FOREIGN PATENT DOCUMENTS

| | | |
|---|---|---|
| EP | 0319912 A2 | 6/1989 |
| EP | 0473852 A1 | 3/1992 |

(Continued)

*Primary Examiner* — Chih-Cheng Kao

(74) *Attorney, Agent, or Firm* — Kligler & Associates Patent Attorneys Ltd

(57) ABSTRACT

An X-ray tube that may include a cathode that is configured to generate an electron beam; an anode having a cavity that has an opening; wherein the anode is configured to receive the electron beam through the opening and to emit, through the opening, in response to the receiving of the electron beam, an X-ray beam from the opening; and electron optics that are configured to direct the electron beam towards the opening following a path that outside the cavity and in a vicinity of the opening, differs from a path of propagation the X-ray beam.

18 Claims, 10 Drawing Sheets

(56) References Cited

U.S. PATENT DOCUMENTS

| | | | | |
|---|---|---|---|---|
| 4,689,809 | A | 8/1987 | Sohval | |
| 4,748,650 | A | 5/1988 | Ammann | |
| 4,788,705 | A | 11/1988 | Anderson | |
| 4,827,494 | A | 5/1989 | Koenigsberg | |
| 4,899,354 | A | 2/1990 | Reinhold | |
| 4,902,940 | A | 2/1990 | Herbert | |
| 4,916,721 | A | 4/1990 | Carr et al. | |
| 5,018,181 | A | 5/1991 | Iversen et al. | |
| 5,022,064 | A | 6/1991 | Iketaki | |
| 5,105,456 | A | 4/1992 | Rand et al. | |
| 5,148,462 | A * | 9/1992 | Spitsyn | H01J 35/08 378/143 |
| 5,657,365 | A | 8/1997 | Yamamoto et al. | |
| 5,682,412 | A | 10/1997 | Skillicorn et al. | |
| 5,703,924 | A | 12/1997 | Hell et al. | |
| 5,745,546 | A * | 4/1998 | Hell | H01J 35/08 378/143 |
| 5,812,632 | A | 9/1998 | Schardt et al. | |
| 5,822,395 | A | 10/1998 | Schardt et al. | |
| 5,751,784 | A | 12/1998 | Enck | |
| 5,857,008 | A | 1/1999 | Reinhold | |
| 6,181,771 | B1 | 1/2001 | Hell et al. | |
| 6,282,263 | B1 | 8/2001 | Arndt et al. | |
| 6,339,635 | B1 | 1/2002 | Schardt et al. | |
| 6,438,207 | B1 | 8/2002 | Chidester et al. | |
| 6,661,876 | B2 | 12/2003 | Turner et al. | |
| 6,778,633 | B1 | 8/2004 | Loxley et al. | |
| 6,947,522 | B2 | 9/2005 | Wilson et al. | |
| 6,975,703 | B2 | 12/2005 | Wilson et al. | |
| 6,993,115 | B2 | 1/2006 | McGuire et al. | |
| 7,257,193 | B2 | 8/2007 | Radley et al. | |
| 7,706,506 | B1 | 4/2010 | Woodruff et al. | |
| 7,983,394 | B2 | 7/2011 | Kozaczek et al. | |
| 8,416,920 | B2 | 4/2013 | Okumura et al. | |
| 8,472,586 | B2 | 6/2013 | Ueda et al. | |
| 8,953,746 | B2 | 2/2015 | Roshi et al. | |
| 9,748,070 | B1 * | 8/2017 | Wall | H01J 35/106 |
| 9,852,875 | B2 | 12/2017 | Wall | |
| 2003/0021377 | A1 | 1/2003 | Turner et al. | |
| 2004/0136499 | A1 * | 7/2004 | Holland | H01J 35/10 378/119 |
| 2010/0290596 | A1 * | 11/2010 | Sakabe | H01J 35/14 378/144 |
| 2011/0058655 | A1 | 3/2011 | Okumura et al. | |
| 2011/0188625 | A1 | 8/2011 | Roshi et al. | |
| 2012/0128117 | A2 | 5/2012 | Roshi et al. | |
| 2012/0269326 | A1 | 10/2012 | Adler et al. | |
| 2013/0235975 | A1 | 9/2013 | Tamura et al. | |
| 2014/0105367 | A1 | 4/2014 | Horvarth et al. | |
| 2014/0369469 | A1 | 12/2014 | Ogura et al. | |
| 2015/0003587 | A1 * | 1/2015 | Kim | A61B 6/4014 378/62 |

FOREIGN PATENT DOCUMENTS

| | | | |
|---|---|---|---|
| EP | 2050100 | A2 | 4/2009 |
| GB | 1444109 | A | 7/1976 |
| JP | 04036943 | A | 2/1992 |
| JP | 10340695 | A | 12/1998 |
| WO | 9813853 | A1 | 4/1998 |

* cited by examiner

PRIOR ART

PRIOR ART

200

X-RAY TUBE

CROSS REFERENCE

This application claims priority from U.S. provisional patent filing date Nov. 8, 2018, Ser. No. 62/757,297.

BACKGROUND

X-rays are used to analyze objects such as but not limited to semiconductor substrates.

Rotating anode (RA) X-ray sources are too costly and may have higher maintenance requirements then desirable for some applications Liquid metal jet (LMJ) X-ray sources can have stability, reliability and downtime problems as well as high cost of ownership.

Exotic X-ray sources, such as synchrotron and Inverse Compton Scattering sources, are not currently suitable for manufacturing facilities.

Various other solid anode X-ray tubes are limited by heat loading—power density produced by e-beam on the anode.

FIG. 1 illustrates a prior art solid anode 10. The anode 10 typically has a sloped surface that is illuminated by an electron beam 20, that causes the anode to emit one or more X-rays 30.

In order to increase the effective brightness with the same power density dissipation an elongated spot with low take-off angle is used.

FIG. 2 illustrates a tradeoff between various parameters of the prior art anode 10 and defines important parameters in the generation of X-rays from solid anodes.

For the given effective spot size a tube may be optimized by electron beam spot length, take-off and incidence angle. It depends on anode material and X-ray line which values of the parameters should be used. For example, it is preferable to obtain X-rays with a longer wavelength using a large take-off angle because of high attenuation due to self-absorption at low takeoff angles. Decreasing of the e-beam incidence angle from one hand decreases attenuation depth and from another increases probability of electrons reflection.

There is a growing need to provide an improved X-ray tube.

SUMMARY

There may be provided a method for generating an X-ray beam, the method may include: (a) illuminating a cavity of an anode with an electron beam that passes through an opening of the cavity; and (b) emitting, by the anode and through the opening, at least one X-ray beam, due to the illuminating of the cavity. The X-ray beam may propagate, outside the cavity and in a vicinity of the opening, at a path that differs from a path of propagation of the electron beam towards the opening.

There may be provided an X-ray tube that may include (a) a cathode that may be configured to generate an electron beam; (b) an anode having a cavity that has an opening; wherein the anode may be configured to receive the electron beam through the opening and to emit, through the opening, in response to the receiving of the electron beam, an X-ray beam from the opening; and (c) electron optics that are configured to direct the electron beam towards the opening following a path that outside the cavity and in a vicinity of the opening, differs from a path of propagation the X-ray beam.

The vicinity of the opening may include a region that span a few millimeters, few centimeters, and the like from the opening.

The cavity may be formed in a body of the anode.

The body may be made of at least one metallic element.

The body may include different parts that differ from each other by composition.

The different parts may include a first part and a second part, wherein a tip of the cavity may be located at the border between the first part and the second part.

The anode may include a base and an active area, wherein the active area may be configured to emit the X-ray beam in response to the receiving of the electron beam; wherein the base may be thermally coupled to the active area; and wherein the base has a thermal conductivity that exceeds a thermal conductivity of the active area.

The base may be a synthetic diamond.

The X-ray tube may include an electron transparent material; wherein the active area may be positioned between the electron transparent material and the base.

The cavity may be radially symmetric.

The cavity may pass only through a part of a length of the anode.

The X-ray may be generated without or substantially without transmissive propagation of the X-ray through the anode.

The electron optics may be configured to direct the electron beam towards the opening by bending the electron beam.

The anode may include a base and an active area, and the method may include emitting, by the active area, the X-ray beam in response to the receiving of the electron beam; wherein the base may be thermally coupled to the active area; and wherein the base has a thermal conductivity that exceeds a thermal conductivity of the active area.

The method further may include an electron transparent material; wherein the active area may be positioned between the electron transparent material and the base.

The method may include encapsulating, by the electron transparent material, the active area and preventing, by the electron transparent material, a sublimation of the active area.

BRIEF DESCRIPTION OF THE DRAWINGS

In order to understand the invention and to see how it may be carried out in practice, a preferred embodiment will now be described, by way of non-limiting example only, with reference to the accompanying drawings.

DETAILED DESCRIPTION OF THE DRAWINGS

Figure 1:
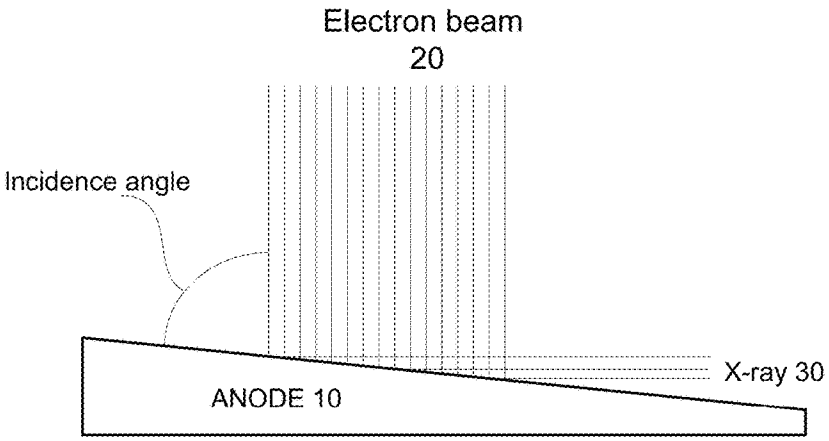
FIG. 1 illustrates an example of a prior art solid anode.
Figure 2:
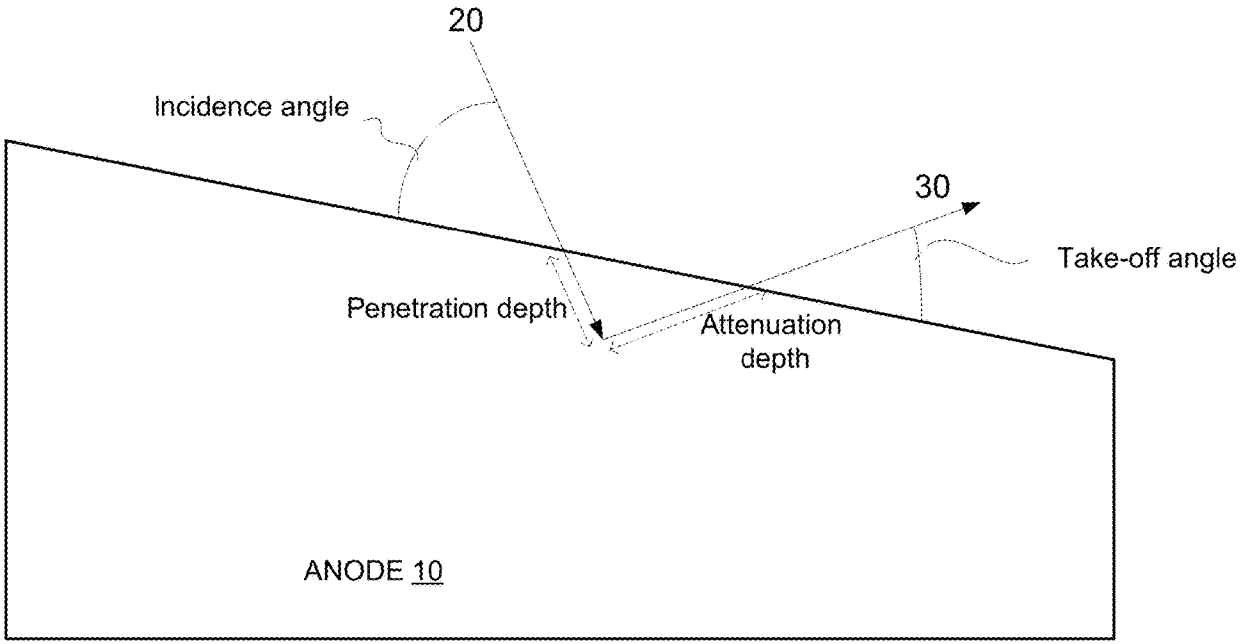
FIG. 2 illustrates an example of a prior art solid anode.
Figure 3:
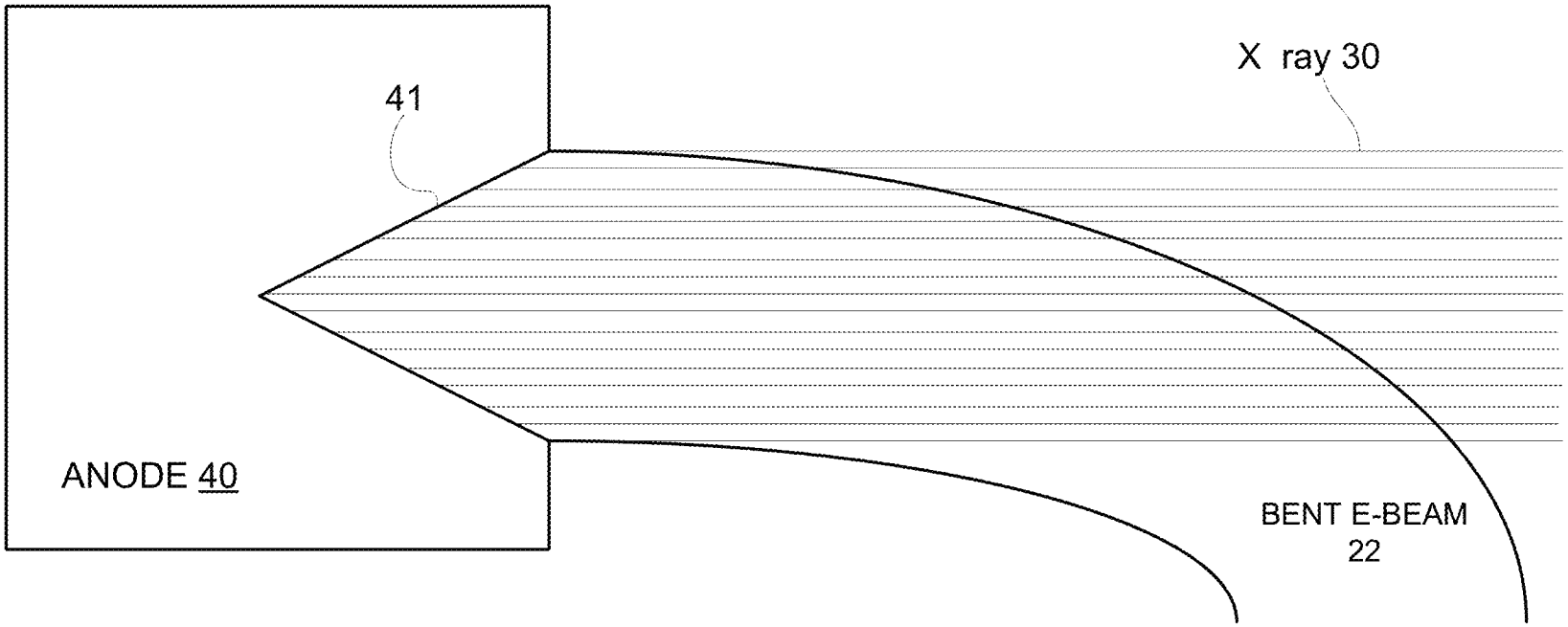
FIG. 3 illustrates an example of an anode.

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

Any reference in the specification to a method should be applied mutatis mutandis to a apparatus capable of executing the method and to a computer program product that stores instructions for executing the method.

Any reference in the specification to an apparatus should be applied mutatis mutandis to a method that may be executed by the apparatus and to a computer program product that stores instructions for executing the method.

Any reference in the specification to a computer program product should be applied mutatis mutandis to a method that is performed when executing instructions stored in the computer program product and to an apparatus that is arranged and construed to execute the instructions stored in the computer program product.

The computer program product is non-transitory and may include a non-transitory medium for storing instructions. Non-limiting examples of a computer program product are a memory chip, an integrated circuit, a disk, a magnetic memory unit, and a memristor memory unit.

The assignment of the same reference numbers to various components may indicate that these components are similar to each other.

There may be provided an anode, a device that includes an anode, a method for generating one or more X-ray beams, and a computer readable medium that stores instructions for controlling a generating of one or more X-ray beams.

The cavity is illuminated with an electron beam. The illumination causes the cavity to emit one or more X-ray beams.

The cavity has an opening. The electron beam enters the opening while the one or more X-ray beams exit the cavity through the same opening.

It may be desired to separate the path of the electron beam from the path of the one or more X-ray beams. This can be done by using any electron optics—and at any location. In FIGS. 3-8 this is achieved by bending (deflecting) the electron beam.

The cavity may have radial symmetry or may be radially asymmetric. The cavity may have any shape—for example it may be conical, non-conical, ellipsoid, circular, and the like.

The cross section of the cavity may be linear, may include linear parts, may be curved, may include curved parts, may include a combination of linear and non-linear portions, and the like. The cross section may be smooth or non-smooth, with teeth, protuberances, steps, and the like. See, for example, FIGS. 7-8.

The emitted X-rays may be parallel to each other, or may be oriented at some angle to each other. A pair of X-ray beams may be parallel to each other while another pair of X-ray beams may be oriented at some angle to each other.

An X-ray beam may exit the opening at ninety degrees in relation the opening or at substantially any angle (between zero and 180 degrees) in relation to the opening.

FIGS. 3-8 illustrates the rays within the X-ray beam 30 that are parallel to each other and are normal to the opening. This is merely a non-limiting example of the propagation angle and of the spatial relationship between the X-ray beams.

The anode can be made of various materials and/or include various parts and/or be positioned near various parts. Some non-limiting examples are shown in FIGS. 3-6.

FIGS. 3-8 illustrate various examples of cross sections and top views of the cavity—but these are merely non-limiting examples.

For simplicity of explanation the following text and FIGS. 3-6 illustrates a cavity that is conical, and the anode is referred to as a cone anode. This is merely an example.

There may be provided a cone anode having a conical cavity in which the e-beam is focused inside the conical cavity formed in a solid anode body. It allows to increase drastically irradiated area saving the same effective spot size, which is equal to cone base area, and so increases possible power for the same dissipated e-beam power density.

For example, in micro-focus solid anode tube typical spot size 50×500 $\mu m^2$ (effective spot size 50 μm when viewed with a 6 deg takeoff angle), for the cone anode with the same effective spot size upper cavity diameter of 50 μm and cavity depth of 3 mm we will get irradiated area of 50×3.14×3000 $\mu m^2$, in 19 times more.

The walls of the cavity may be smooth or not smooth. For example—the walls of the cavity may have an engineered surface topography such as undulating or stepped surface rather than be planar. The surface topology of the walls of the cavity walls may be shaped and sized in order to minimize elastic scattering of the electrons from the surface without the generation of X-ray photons.

Of course, such design will demand magnetic e-beam optics, which will allow focusing, movement and bending of e-beam.

The cone anode may exhibit the following:

a. It provides a larger area for e-beam energy dissipation for the same effective spot size comparing with flat anodes.
b. Low self-absorption with respect to flat anodes because the X-ray propagates in the electrons incidence direction and the attenuation depth may be equal for penetration depth. For example in the regular flat 6° anode tube attenuation depth in 10 times longer than penetration one. Low sensitivity for walls roughness for the same reason.
c. High efficiency because of high probability of interaction with opposite wall for the reflected electrons.
d. Absence of a Be window damage, which is possible in a through-hole anode.
e. Obtaining a simpler cooling scheme (see for example FIGS. 5 and 6) than in the through-hole anode. (see, for example, U.S. Pat. No. 9,748,070).
f. X-ray beam produced by cone anode may have a Gaussian like intensity distribution and not donut shaped like in through-hole anode. Gaussian line intensity may be beneficial for various applications—especially when the maximal intensity of the X-ray beam is at the center of the X-ray beam.
g. Smaller and simpler than RA or LMJ sources with comparable brightness.

The body of the anode can be made of at least one metallic element, including but not limited to aluminum, chromium, copper, molybdenum, rhodium, tungsten, silver or gold.

Figure 4:
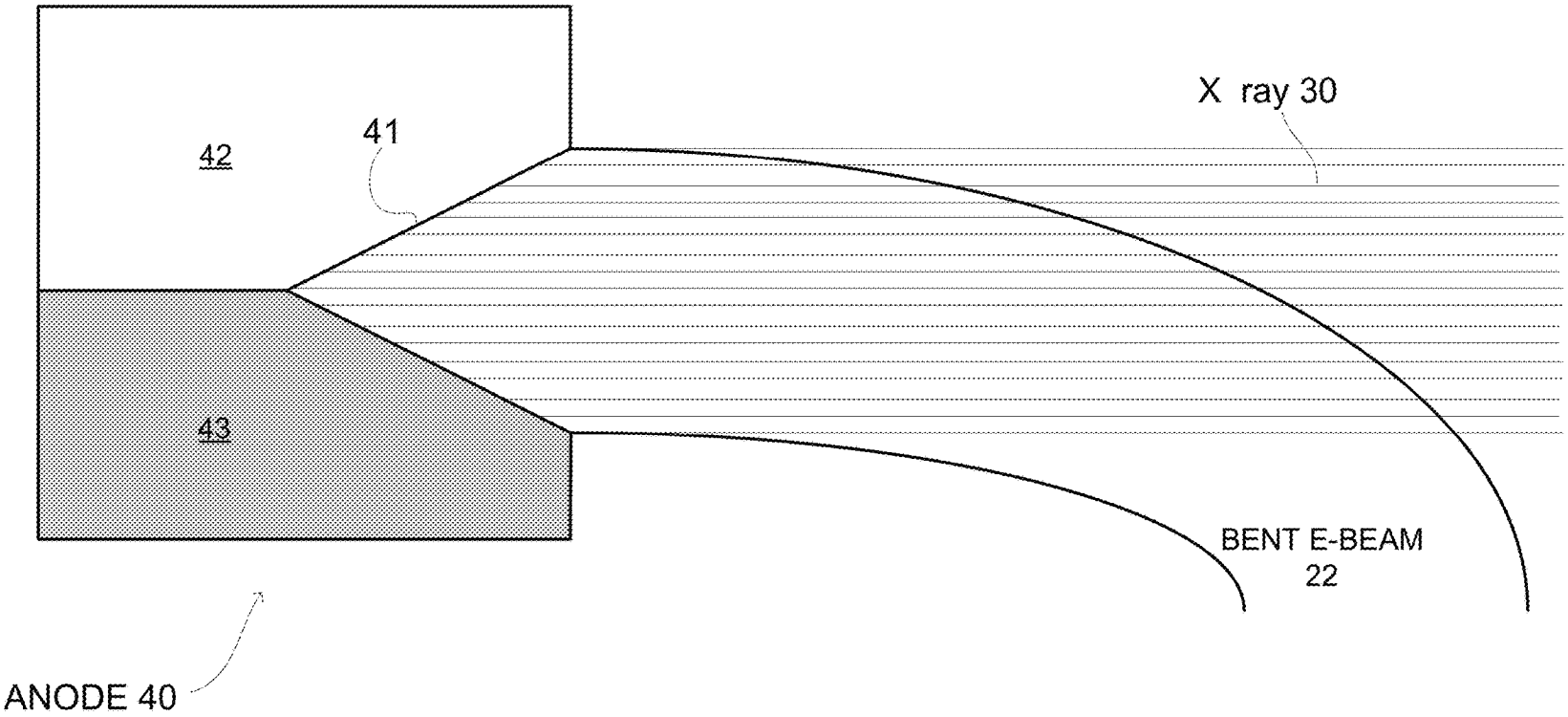
FIG. 4 illustrates an example of an anode.

The body of the anode may include different parts that differ from each other by composition. FIG. 4 illustrates a body that is made of first part 42 and second part 43 (of different materials—for example metals/alloys). The tip of the cavity may be located at the border between the two parts.

Figure 5:
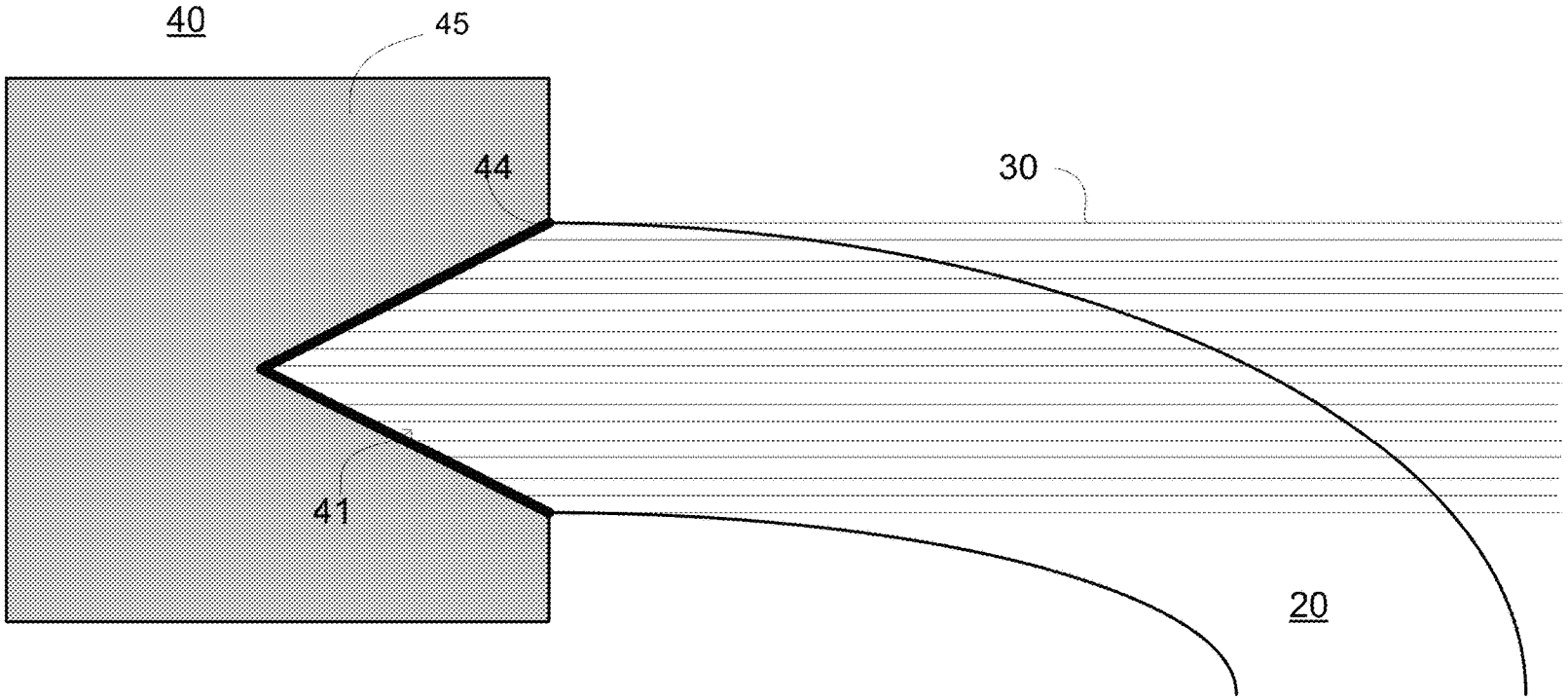
FIG. 5 illustrates an example of an anode.

FIG. 5 illustrates that the base of the anode 45 may include a material of higher thermal conductivity than the material(s) of the active area 44 of the anode that emitting X-rays. The base 45 can be made of materials such as synthetic diamond. The X-ray emitting materials being deposited by CVD, PVD or some other film deposition process. This configuration enables efficient cooling of the anode.

Figure 6:
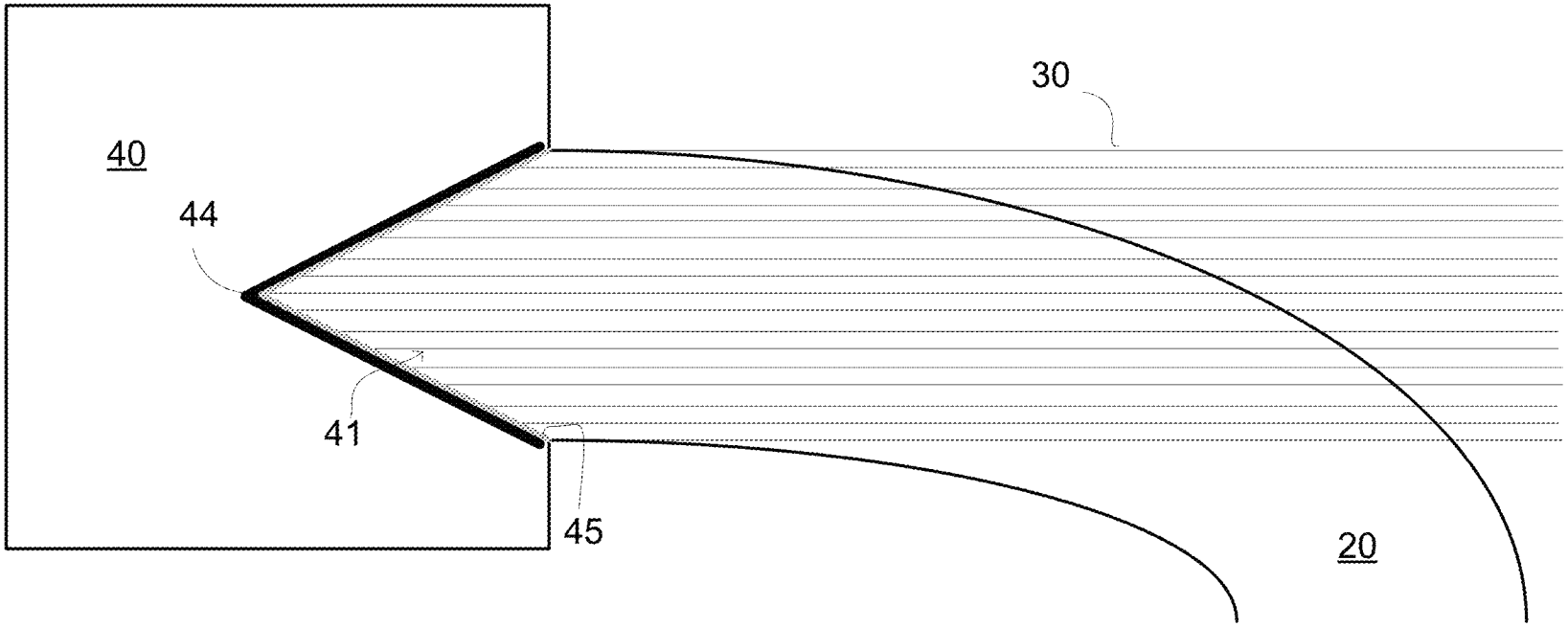
FIG. 6 illustrates an example of an anode.
Figure 7:
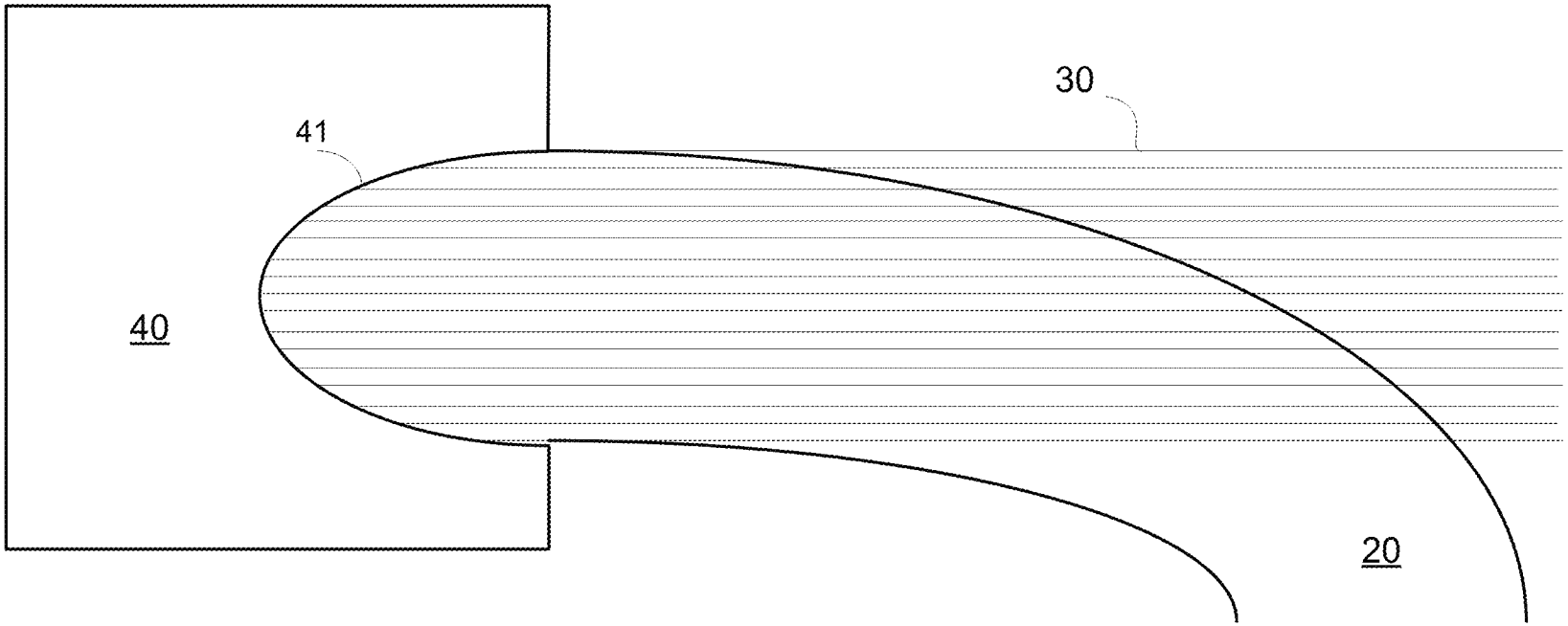
FIG. 7 illustrates an example of an anode.
Figure 8:
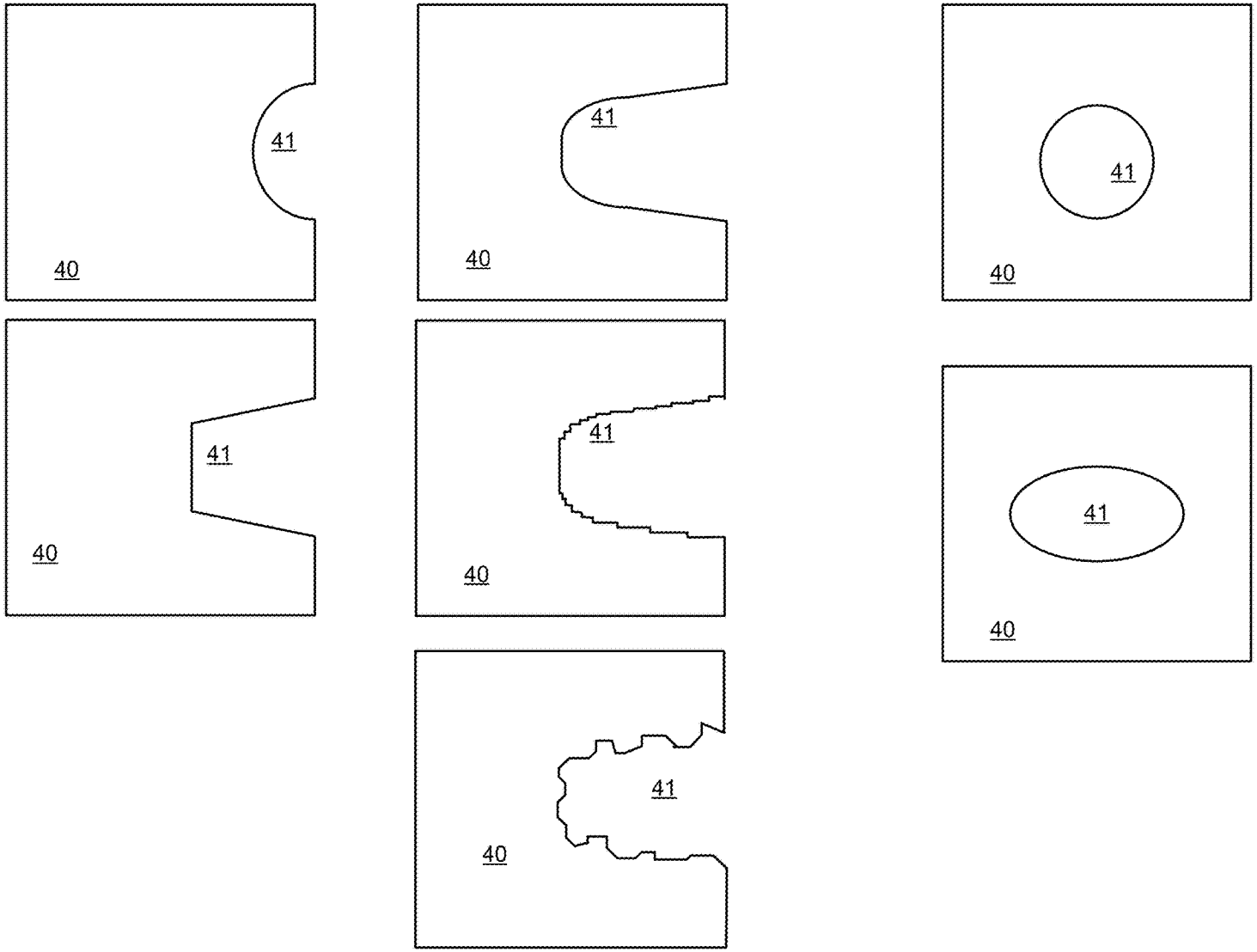
FIG. 8 illustrates an example of an anode.

FIG. 6 illustrates that the active area 44 of the anode (the X-ray emitting material(s)) may be coated with an electron transparent materials 45 such as graphite, graphene, or diamond barrier film so as to encapsulate and prevent sublimation of the X-ray emitting material(s) of the active area. This configuration enables efficient cooling of the anode.

One or more of the various anode construction embodiments may be combined.

The cavity should not be a pass through cavity that passes through the entire length (or width) of the anode.

An X-ray tube incorporating the cone anode will also include an electron emitting source (cathode) and electron focusing/steering optics.

The cathode may include on refractory metal such as Tungsten, or other "hot" electron emitter.

Other cathode options include but are not limited to dispenser cathodes and $LaB_6$ emitters The electron optics may include electrostatic and electromagnetic elements or some combination of both.

In an embodiment of an X-ray tube with a cone anode, the electron emission and steering is achieved under closed loop control using a computer, microcontroller or dedicated electronic system.

The current, voltage, focusing and steering of the electron beam is adjusted and one or more signals that may include the X-ray emissions are used to adjust the tube emissions in a controlled manner.

Figure 9:
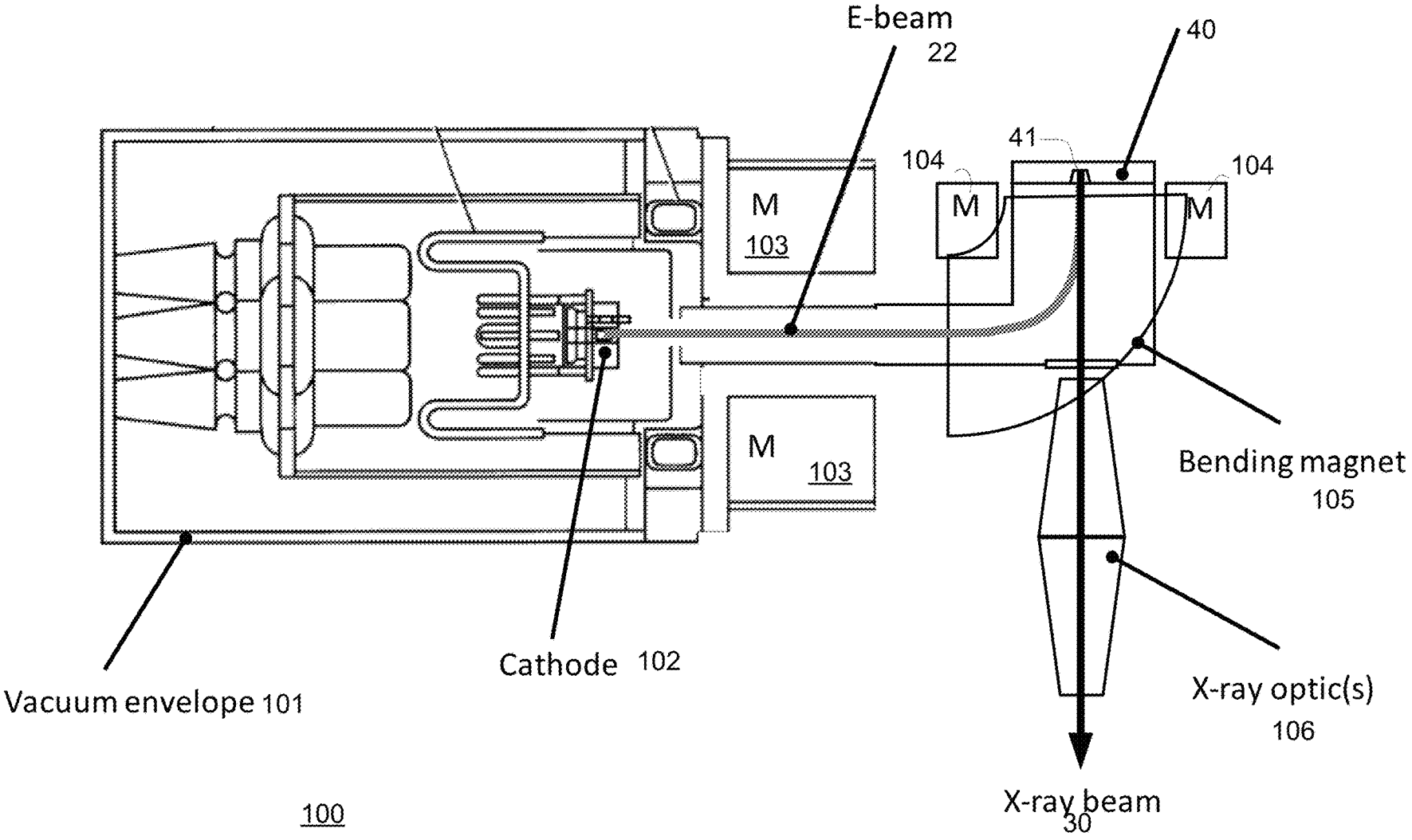
FIG. 9 illustrates an example of a device that has an anode.

FIG. 9 illustrates an X-ray tube 100 that includes cathode 102, anode 40 (with cavity 41), electron optics (such as magnets 103, 104 and bending magnet 105), the cathode 102 is located within a vacuum envelope 101. The entire X-ray tube 100, only parts of the X-ray tube 100, or additional elements of a system may be maintained in vacuum. For example—the X-ray beam 30 and an evaluated sample may be maintained in vacuum.

At least the bending magnet 105 bends the electron beam 22 towards the anode 40.

In FIG. 9 the electron beam is bent by ninety degrees and both the electron beam and the X-ray beam are perpendicular to an opening of the cavity 41 of the anode. Other angular relationships may be provided.

Figure 10:
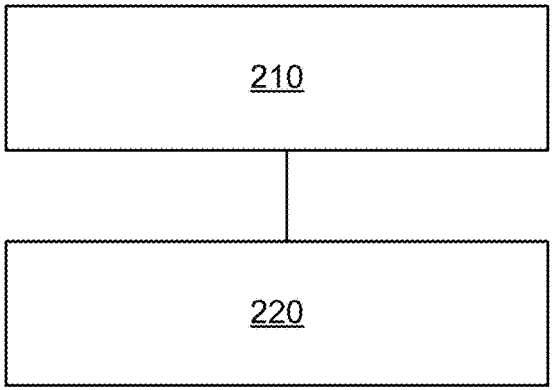
FIG. 10 illustrates an example of a method.

FIG. 10 illustrates a method 200.

Method 200 may include steps 210 and 220.

Step 210 may include illuminating a cavity of an anode with an electron beam. The electron beam passes through an opening of the cavity.

Step 220 may include emitting, by the anode, at least one X-ray beam, due to the illuminating of the cavity. The at least one X-ray passes through the opening.

Multiple iterations of steps 210 and 220 may be executed.

Method 230 may include monitoring a parameter of the X-ray beam. The monitoring may be executed in any known monitoring manner such as directly or indirectly estimating a parameter of the X-ray beam, the parameter may include intensity, shape, size, polarity, angle of propagation, and the like.

The monitoring may be followed by controlling the generation of the X-ray beam based on the results of the monitoring.

There may be provided one or more anodes that may include multiple cavities, each cavity may be illuminated by the electron beam and emits one or more X-ray beams.

In the foregoing specification, the invention has been described with reference to specific examples of embodiments of the invention. It will, however, be evident that various modifications and changes may be made therein without departing from the broader spirit and scope of the invention as set forth in the appended claims.

Moreover, the terms "front," "back," "top," "bottom," "over," "under" and the like in the description and in the claims, if any, are used for descriptive purposes and not necessarily for describing permanent relative positions. It is understood that the terms so used are interchangeable under appropriate circumstances such that the embodiments of the invention described herein are, for example, capable of step in other orientations than those illustrated or otherwise described herein.

Those skilled in the art will recognize that the boundaries between logic blocks are merely illustrative and that alternative embodiments may merge logic blocks or circuit elements or impose an alternate decomposition of functionality upon various logic blocks or circuit elements. Thus, it is to be understood that the architectures depicted herein are merely exemplary, and that in fact many other architectures may be implemented which achieve the same functionality.

Any arrangement of components to achieve the same functionality is effectively "associated" such that the desired functionality is achieved. Hence, any two components herein combined to achieve a particular functionality may be seen as "associated with" each other such that the desired functionality is achieved, irrespective of architectures or intermedial components. Likewise, any two components so associated can also be viewed as being "operably connected," or "operably coupled," to each other to achieve the desired functionality.

Furthermore, those skilled in the art will recognize that boundaries between the above described steps are merely illustrative. The multiple may be combined into a single step, a single step may be distributed in additional steps and steps may be executed at least partially overlapping in time. Moreover, alternative embodiments may include multiple instances of a particular step, and the order of steps may be altered in various other embodiments.

The specifications and drawings are, accordingly, to be regarded in an illustrative rather than in a restrictive sense.

The word 'comprising' does not exclude the presence of other elements or steps then those listed in a claim. Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles. Unless stated otherwise, terms such as "first" and "second" are used to arbitrarily distinguish between the elements such terms describe. Thus, these terms are not necessarily intended to indicate temporal or other prioritization of such elements. The mere fact that certain measures are recited in mutually different claims does not indicate that a combination of these measures cannot be used to advantage.

The terms "having", "including", "consisting" and "consisting essentially of" are used in an interchangeable manner. Thus—if the apparatus is described as having certain parts—it may include other parts, may include only the certain parts or may substantially consist of the certain parts.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

We claim:

1. An X-ray tube, comprising:

a cathode that is configured to generate an electron beam;

an anode having a cavity comprising: (a) an opening having a two-dimensional (2D) shape defined on a surface of the anode, and (b) one or more walls, which extend from the opening into a body of the anode, wherein, in response to receiving the electron beam, the cavity is configured to emit an X-ray beam having a 2D spot, including shaping the 2D spot in a two-dimensional Gaussian distribution; and electron optics, comprising a bending magnet that is configured to bend the electron beam by ninety degrees and to direct the electron beam toward the opening in a propagation path, which is perpendicular to the opening.

2. The X-ray tube according to claim 1, wherein the one or more walls of the cavity are shaped into the body of the anode to control at least one of an intensity, the shape and a direction of the emitted X-ray.

3. The X-ray tube according to claim 2, wherein the body is made of at least one metallic element.

4. The X-ray tube according to claim 2, wherein the body comprises different parts that differ from each other by composition.

5. The X-ray tube according to claim 4, wherein the different parts comprise a first part and a second part, wherein a tip of the cavity is located at the border between the first part and the second part.

6. The X-ray tube according to claim 1, wherein the anode comprises a base and an active area, wherein the active area is configured to emit the X-ray beam in response to the receiving of the electron beam, wherein the base is thermally coupled to the active area, and wherein the base has a thermal conductivity that exceeds a thermal conductivity of the active area.

7. The X-ray tube according to claim 6, wherein the base comprises a synthetic diamond.

8. The X-ray tube according to claim 6, further comprising an electron transparent material, wherein the active area is positioned between the electron transparent material and the base.

9. The X-ray tube according to claim 1, wherein the 2D shape of the opening has a radial symmetry.

10. The X-ray tube according to claim 1, wherein the cavity passes only through a part of a length of the anode.

11. The X-ray tube according to claim 1, wherein at least one of the walls of the cavity has a wall-surface comprising a non-planar topography.

12. A method for generating an X-ray beam, the method comprises:

generating an electron beam, and bending the electron by ninety degrees using a bending magnet;

illuminating at least a cavity of an anode with the bent electron beam such that the electron beam passes through an opening of the cavity, wherein the cavity comprises: (a) an opening having a two-dimensional (2D) shape defined on a surface of the anode, and (b) one or more walls, which extend from the opening into a body of the anode;

emitting through the opening, in response to receiving the electron beam into the cavity, an X-ray beam having a 2D spot, including shaping the 2D spot in a two-dimensional Gaussian distribution; and directing the electron beam toward the opening in a propagation path, which is perpendicular to the opening.

13. The method according to claim 12, wherein the one or more walls of the cavity are shaped into the body of the anode to control at least one of an intensity, the shape and a direction of the emitted X-ray.

14. The method according to claim 13, wherein the body is made of at least one metallic element.

15. The method according to claim 13, wherein the body comprises different parts that differ from each other by composition.

16. The method according to claim 12, wherein the anode comprises a base and an active area, wherein the method comprises emitting, by the active area, the X-ray beam in response to the receiving of the electron beam, wherein the base is thermally coupled to the active area, and wherein the base has a thermal conductivity that exceeds a thermal conductivity of the active area.

17. The method according to claim 16, wherein the base comprises a synthetic diamond.

18. The method according to claim 16, further comprising an electron transparent material, wherein the active area is positioned between the electron transparent material and the base.

* * * * *